US008648775B2

(12) United States Patent
Kim et al.

(10) Patent No.: US 8,648,775 B2
(45) Date of Patent: Feb. 11, 2014

(54) ORGANIC LIGHT EMITTING DISPLAY HAVING AN ONSCREEN DISPLAY AREA CONTROLLED DIFFERENTLY RESPONSIVE TO AN EXTERNAL LIGHT, AND DRIVING METHOD THEREOF

(75) Inventors: Hyeonggwon Kim, Yongin-si (KR); Kinyeng Kang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1052 days.

(21) Appl. No.: 12/013,133

(22) Filed: Jan. 11, 2008

(65) Prior Publication Data

US 2008/0231563 A1 Sep. 25, 2008

(30) Foreign Application Priority Data

Mar. 23, 2007 (KR) ..... 10-2007-0028830

(51) Int. Cl.
*G09G 3/30* (2006.01)

(52) U.S. Cl.
USPC ..... 345/76

(58) Field of Classification Search
USPC ..... 345/76–89; 315/169.3
See application file for complete search history.

(56) References Cited

U.S. PATENT DOCUMENTS 6,563,479 B2 * 5/2003 Weindorf et al. ..... 345/77
2005/0117190 A1 * 6/2005 Iwauchi et al. ..... 359/237
2005/0264496 A1 * 12/2005 Shin ..... 345/76
2005/0264497 A1 * 12/2005 Shin et al. ..... 345/76
2005/0275651 A1 * 12/2005 Plut ..... 345/211
2006/0022899 A1 * 2/2006 Johnson ..... 345/55
2006/0087478 A1 * 4/2006 Eom ..... 345/45
2006/0114193 A1 * 6/2006 Kwak et al. ..... 345/76
2006/0187347 A1 * 8/2006 Tsai ..... 348/500
2006/0202920 A1 * 9/2006 Shibusawa ..... 345/76
2006/0244387 A1 * 11/2006 Park et al. ..... 315/169.1
2006/0244697 A1 * 11/2006 Lee et al. ..... 345/77

FOREIGN PATENT DOCUMENTS

KR 10-2005-0026485 A 3/2005
KR 10-2006-0046635 A 5/2006
KR 10-2006-0054105 A 5/2006

* cited by examiner

*Primary Examiner* — Pegeman Karimi
(74) *Attorney, Agent, or Firm* — Christie, Parker & Hale, LLP

(57) ABSTRACT

An organic light emitting display and a driving method thereof capable of improving outdoor visibility by controlling the emission of the pixel. In one embodiment, the organic light emitting display includes an organic light emitting display panel; an emission control driver of the organic light emitting display panel; a sensor unit for outputting an electrical output signal by sensing an external light; a signal processing unit for determining an indoor mode or an outdoor mode in accordance with the output signal outputted from the sensor unit; an onscreen display control unit electrically connected to the signal processing unit and for controlling the emission control driver of the organic light emitting display panel; and an onscreen display area comprising a pixel circuit electrically connected to the emission control driver. Here, the pixel circuit of the onscreen display area is controlled by the emission control driver.

20 Claims, 8 Drawing Sheets

PRIOR ART

PRIOR ART

ORGANIC LIGHT EMITTING DISPLAY HAVING AN ONSCREEN DISPLAY AREA CONTROLLED DIFFERENTLY RESPONSIVE TO AN EXTERNAL LIGHT, AND DRIVING METHOD THEREOF

CROSS-REFERENCE TO RELATED APPLICATION

This application claims priority to and the benefit of Korean Patent Application No. 10-2007-0028830, filed on Mar. 23, 2007, the entire content of which is incorporated herein by reference.

BACKGROUND OF THE INVENTION

1. Field of the Invention

The present invention relates to an organic light emitting display and a driving method thereof.

2. Description of the Related Art

An organic light emitting display is a next-generation flat type display that has a relatively thin thickness, wide viewing angle and rapid response time.

Referring to FIG. 1, an organic light emitting diode (OLED) of an organic light emitting display is composed of an anode (ITO), an organic thin film and a cathode (metal). The organic thin film is composed of a multilayer structure including an emission layer, an electron transport layer (ETL) and a hole transport layer (HTL), and the multilayer structure may further include a separate electron injecting layer (EIL) and a hole injecting layer (HIL).

The organic light emitting display controls the brightness of each pixel and displays images by controlling the amount of current flowing into the organic light emitting diode (OLED) of each pixel. That is, the current corresponding to the data voltage is supplied to the OLED, and then the OLED emits light according to the supplied current. Here, the applied voltage can have various levels within a specific range to express a gradation.

Generally, self-emitting displays are devices for self-emitting light when the electric energy or other energies are supplied. Examples of a self-emitting display include a light emitting diode (LED) display, a cathode ray tube (CRT) display, a plasma display panel (PDP), an electroluminescence (EL) display, a field emission display (FED) and so on.

Self-emitting displays are widely used, because that they offer excellent visibility in low-light conditions, and their manufacturing methods are usually simpler than a non-self-emitting display, such as a liquid crystal display (LCD). In addition, the self-emitting display consumes relatively less power. However, there is a disadvantage in that the visibility of these displays, in a case where external light is great, is considerably lower than that of a reflective liquid crystal display, and thus it is problematic to use them in high-light conditions.

In particular, mobile displays provided with an active matrix organic light emitting display (AMOLED) are often displayed in the outdoor, and therefore the mobile displays with the AMOLED have to solve the problem of low visibility in the outdoor. That is, the display element of the AMOLED should be relatively bright when it is turned on in order to have proper visibility under strong external light. Otherwise, the contrast ratio is considerably reduced and thus the visibility is degraded.

However, a method, which always turns on the display element brightly, result in that power consumption is high and more current flows into the organic light emitting diode OLED, and therefore there is a problem in that the lifespan of the organic light emitting diode OLED is reduced.

SUMMARY OF THE INVENTION

An aspect of an embodiment of the present invention is directed to an organic light emitting display that can sense a place it is in. More specifically, an aspect of an embodiment of the present invention is directed to an organic light emitting display that can display brightness by utilizing an embedded photo sensor capable of sensing external light passing into the organic light emitting display.

Another aspect of an embodiment of the present invention is directed to a circuit of an organic light emitting display that enables an emission-control of each pixel formed on an onscreen display (OSD) area by providing an emission control line for each pixel formed on the OSD area.

Another aspect of an embodiment of the present invention is directed to an organic light emitting display capable of improving outdoor visibility of its onscreen display images by controlling the emission of a reference pixel (which is turned on within the onscreen display area) and the emission of pixels surrounding the reference pixel in accordance with the information about the place in which it is displayed.

An organic light emitting display according to an embodiment of the present invention includes an organic light emitting display panel; an emission control driver of the organic light emitting display panel; a sensor unit for outputting an electrical output signal by sensing an external light; a signal processing unit for determining an indoor mode or an outdoor mode in accordance with the output signal outputted from the sensor unit; an onscreen display control unit electrically connected to the signal processing unit and for controlling the emission control driver of the organic light emitting display panel; and an onscreen display area comprising a pixel circuit electrically connected to the emission control driver. Here, the pixel circuit of the onscreen display area is controlled by the emission control driver.

In one embodiment, the sensor unit is configured on the organic light emitting display panel, and the organic light emitting display panel includes the pixel circuit of the onscreen display area and a plurality of other pixel circuits.

In one embodiment, the sensor unit includes at least one photo-diode.

In one embodiment, the signal processing unit includes a signal converting unit electrically connected to the sensor unit and for converting the output signal of the sensor unit into a digital signal; and a signal determining unit electrically connected to the signal converting unit and for determining the indoor mode or the outdoor mode. The signal converting unit may be adapted to convert the output signal of the sensor unit into a square wave signal, and to eliminate a noise of the output signal of the sensor unit.

In one embodiment, the onscreen display control unit is adapted to select a pixel of the onscreen display area for controlling emission from among pixels in the onscreen display area in accordance with a signal outputted from the signal processing unit.

In one embodiment, the onscreen display control unit is adapted to output an electrical signal for allowing the emission control driver to control an emission time of the onscreen display area.

In one embodiment, the onscreen display area includes an object pixel on which real information is displayed; and an outline pixel serving as a boundary line of the object pixel. Here, when the object pixel is emitting light, the outline pixel may display the boundary line of the object pixel by emitting a complementary color of the object pixel or by emitting no light at all.

A driving method of the organic light emitting display according to an embodiment of the present invention includes sensing an external light by a sensing unit to output an electrical output signal in accordance with the sensing of the external light by the sensing unit; processing the output signal of the sensing unit received by a signal processing unit to determine indoor mode or outdoor mode and to output a processed output signal; onscreen display controlling an emission control driver of an organic light emitting display panel by an onscreen display control unit in accordance with the output signal of the signal processing unit received by the onscreen display control unit; and emitting light in an onscreen display area including at least one pixel circuit electrically connected to the emission control driver and controlled by the emission control driver.

In one embodiment, the sensor unit is formed on the organic light emitting display panel having the at least one pixel circuit and a plurality of other pixel circuits.

In one embodiment, the sensor unit includes at least one photo-diode.

In one embodiment, the signal processing includes converting the output signal of the sensor unit into a digital signal by a signal converting unit electrically connected to the sensor unit; and determining the indoor mode or the outdoor mode signal by the signal determining unit electrically connected to the signal converting unit. Here, the signal converting may include converting the output signal of the sensor unit into a square wave signal by the signal converting unit; and eliminating a noise ingredient of the output signal of the sensor unit.

In one embodiment, the onscreen display controlling includes selecting a pixel for controlling emission from among pixels in the onscreen display area in accordance with the output signal received from the signal processing unit.

In one embodiment, the onscreen display controlling includes outputting an electrical signal by the onscreen display control unit to allow the emission control driver to control an emission time of the onscreen display area.

In one embodiment, the onscreen display area includes an object pixel on which real information is displayed; and an outline pixel for outlining the object pixel. Here, the driving method may further include displaying a boundary line of the object pixel by the outline pixel when the object pixel is emitting light. The displaying the boundary line may include emitting a complementary color of the object pixel by the outline pixel or emitting no light at all by the outline pixel.

In view of the foregoing, the organic light emitting display and the driving method thereof according to embodiments of the present invention may sense the information about the place in which the organic light emitting display is displayed by embedding the photo sensor capable of sensing the intensity of illumination of the external light into the organic light emitting display.

Also, it is possible to emission-control the respective pixel formed on the onscreen display area (OSD) by providing an emission control line in each pixel formed on the onscreen display area (OSD).

It is also possible to improve the outdoor visibility of onscreen display images by not only controlling emission of the pixel, which is turned on within the onscreen display area, but also by controlling the emission of surrounding pixels, in accordance with the information about the place where the images are displayed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, simply by way of illustration. As those skilled in the art would realize, the described exemplary embodiments may be modified in various different ways, all without departing from the spirit or scope of the present invention. Accordingly, the drawings and description are to be regarded as illustrative in nature, and not restrictive.

Hereinafter, the structure of an organic light emitting display 100 according to an embodiment of the present invention will be described.

Figure 1:
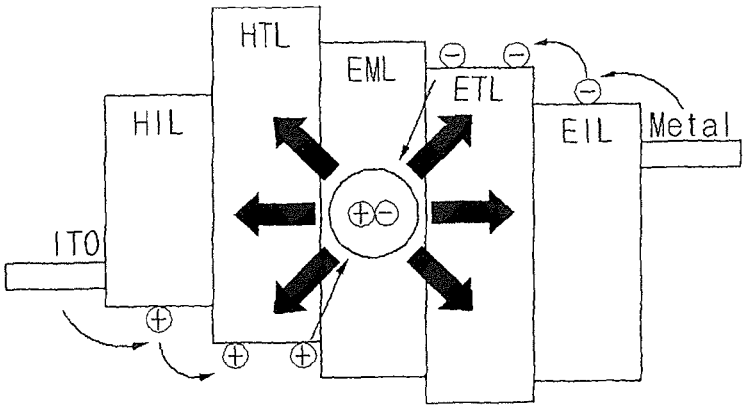
FIG. 1 is a schematic view illustrating a basic structure of a conventional organic light emitting element.
Figure 2:
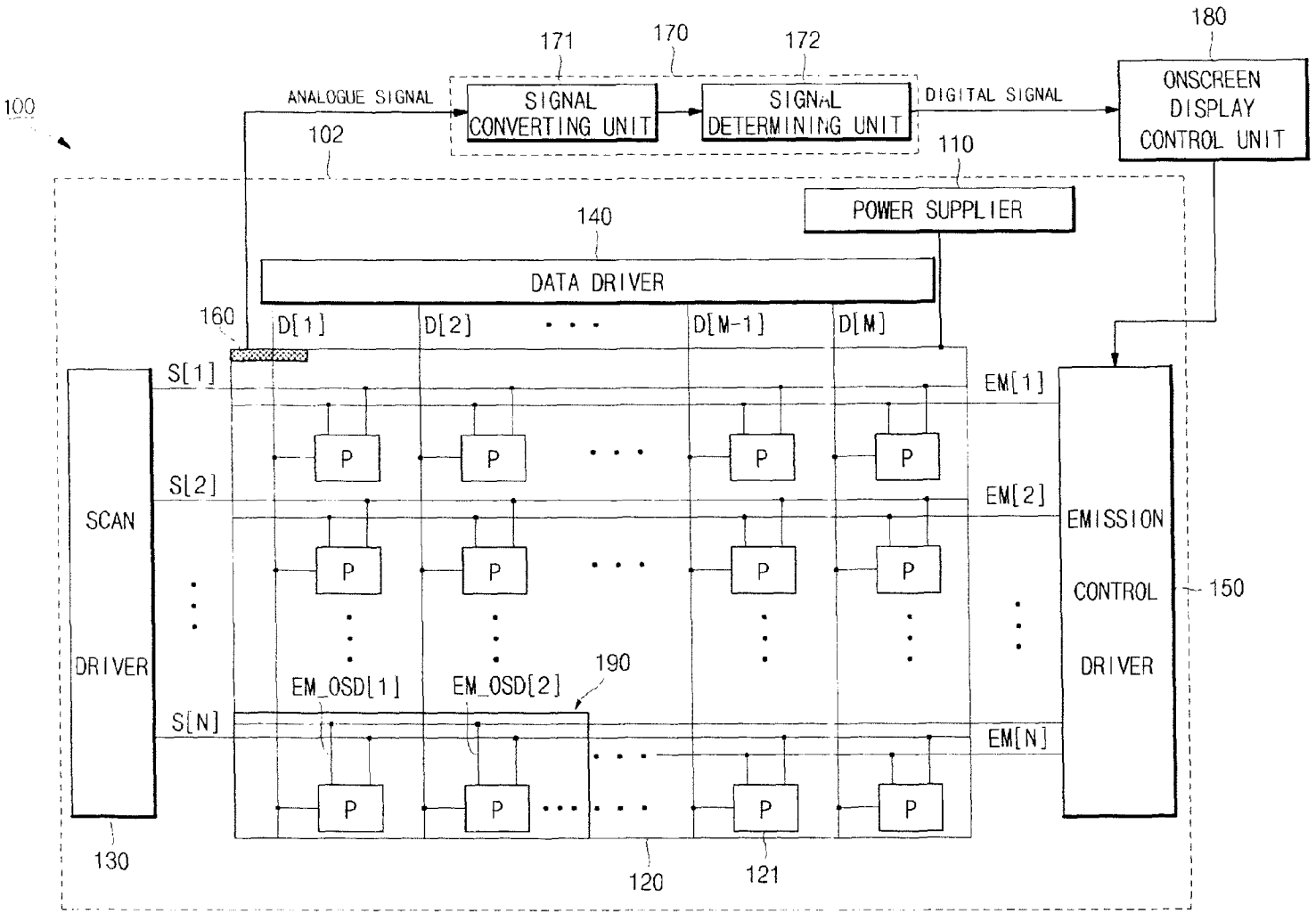
FIG. 2 is a block diagram schematically illustrating a structure of an organic light emitting display according to an embodiment of the present invention.

FIG. 2 is a block diagram schematically illustrating the structure of the organic light emitting display.

As illustrated in FIG. 2, the organic light emitting display 100 may include a power supplier 110, an organic light emitting display panel (or region) 120, a scan driver 130, a data driver 140, an emission control driver 150, a sensor unit 160, a signal processing unit 170, an onscreen display control unit 180, and an onscreen display area 190.

The power supplier 110 serves to supply the power voltage to the respective pixel circuit 121 provided in the organic light emitting display panel 120.

The organic light emitting display panel 120 may include pixel circuits 121 at pixels areas defined by scanning lines (S[1] to S[N]) and emission control lines (EM[1] to EM[N]) arranged in a row direction and data lines (D[1] to D[M]) arranged in a column direction.

Here, a pixel circuit 121 may be formed on a pixel area defined by one of the scanning lines and a corresponding one of the data lines. The scanning signal may be supplied from the scan driver 130 to the scanning lines (S[1] to S[N]), the data signal may be supplied from the data driver 140 to the data lines (D[1] to D[M]), and the emission control signal may be supplied from the emission control driver 150 to the emission control lines (EM[1] to EM[N]).

The scan driver 130 may supply the scanning signal to the organic light emitting display panel 120 via the scanning lines (S[1] to S[N]).

The data driver 140 may supply the data signal to the organic light emitting display panel 120 via the data lines (D[1] to D[M]).

The emission control driver 150 may supply the emission control signal to the organic light emitting display panel 120 via the emission control lines (EM[1] to EM[N]).

The sensor unit 160 may be formed on the organic light emitting display panel 120. As illustrated in FIG. 2, the sensor unit 160 in the organic light emitting display 100 according to an exemplary embodiment of the present invention is formed on the left-upper part of the organic light emitting display panel 120.

The sensor unit 160 may use a photo sensor which is capable of sensing the intensity of illumination of the external light. The sensor unit 160 may use a sensor, which is able to sense that the mobile displays are moved from the indoor to the outdoor by sensing the intensity of illumination of the external light.

As described above, the sensor unit 160 may sense the luminous intensity change of the external light, and supply the electrical analogue signal of the current or the voltage corresponding to the luminous intensity change of the external light into the signal processing unit 170.

The sensor unit 160 may include at least one photo-diode, and it is possible to use a PN photo-diode, a PIN photo-diode and/or an avalanche photo-diode as a photo-diode.

The sensor unit 160 is a suitable sensor that is able to sense the luminous intensity change of the external light, when the mobile displays including the organic light emitting display according to the present invention are moved from the indoor/outdoor to the outdoor/indoor, and thus the present invention is not limited by the type of the photo-sensor. Further, the present invention is not limited by the type of the photo-diode which is able to be used in the sensor unit 160.

Also, as illustrated in FIG. 2, the sensor unit 160 may be formed on the left upper end of the organic light emitting display panel 120; however, the position is not limited thereto, and it may be formed in any place of the organic light emitting display, and thus the present invention is not limited by the position of the sensor unit 160.

The signal processing unit 170 may include a signal converting unit 171 electrically connected to the sensor unit 160, and a signal determining unit 172 electrically connected to the signal converting unit 171.

The signal converting unit 171 may convert the analogue electrical signal applied from the sensor unit 160 into the digital signal. The signal converting unit 171 may be an analog to digital converter (A/D converter). That is, the signal processing unit 170 may sample the analogue signal of the current or the voltage corresponding to the luminous intensity change of the external light, and output the digital signal of a specific bit from the sampled signal.

Also, the signal converting unit 171 may convert the continuous analogue signal into the encoded digital signal, and provide the stable digital signal under noise and irregular environment. The reason for conversion from the analogue signal to digital signal is that it is possible to transfer the signal more efficiently, because the digital signal is more definite and regular than the analogue signal and because it is possible to make an electronic circuit for dividing (e.g., separating or isolating) the signal from the irregular noise more easily.

The signal converting unit 171 may be the analog to digital converter (A/D converter); however, the signal converting unit 171 can be any device capable of converting the analogue signal to the digital signal, and thus the type of the signal converting unit is not restricted to the A/D converter.

The signal determining unit 172 may be electrically connected between the signal converting unit 171 and the onscreen display control unit 180. The electrical signal outputted from the signal converting unit 171 is applied to the signal determining unit 172. Therefore, it is possible to detect the intensity of illumination of the external light where the organic light emitting display panel 120 is arranged (or at). Also, it is possible to determine that the position of the organic light emitting display panel 120 is indoor or outdoor by using the intensity value of illumination of the external light. That is, it is possible to determine an indoor mode or an outdoor mode.

The onscreen display control unit 180 may determine whether the mobile display is moved into a bright site or a dark site by using the digital signal from the signal processing unit 170. Also, even though it is not illustrated in FIG. 2, the onscreen display control unit 180 may include a microcomputer (micom) in order to determine that the mobile display has moved to the bright site from the dark site and/or from the bright site to the dark site. The micom is referred to as a computer composed of a micro processor and a central processing unit on a chip (or on one chip).

The micom may determine whether the mobile display having the organic light emitting display has moved to the bright site from the dark site and/or from the bright site to the dark site and whether the intensity value of illumination of the external light is changed by using the digital electrical signal from the signal processing unit 170. This micom can be any suitable device capable of determining a movement of the organic light emitting display so that the intensity value of illumination of the external light is changed, and thus the present invention is not limited by the type of the micom described above.

Through the exchange of the signal with the micom, the onscreen display control unit 180 may apply an output signal according to the outdoor mode to the emission control driver 150 or an output signal according to the indoor mode to the emission control driver 150. That is, it is possible to supply the control signal corresponding to the present position (indoor or outdoor) of the mobile display to the emission control driver 150.

For example, when the mobile display is determined to be positioned in the outdoor, then the position of the pixels, which serve as an outline of the turned on pixel from the pixels in the onscreen display area 190, are selected, and it is possible to improve the outdoor visibility of the onscreen display information, as the pixels, which serve as an outline, emit the complementary color of the turned on pixels or produce black images.

The onscreen display control unit 180 may select the pixel for controlling the emission from the pixels in the onscreen display area 190, and may apply the electrical signal, which allows the emission control driver 150 to control the emission of the selected pixel, to the emission control driver 150.

That is, this calculation can be processed in the onscreen display control unit 180, and the output signal according to this calculation result is supplied into the emission control driver 150.

However, the onscreen display control unit 180 can be any suitable device that is capable of sensing the luminous intensity change of the place in which the mobile display is displayed by the digital signal from the signal processing unit 170, determining the position change between the indoor or the outdoor, and supplying the output signal according to the outdoor mode or the indoor mode depending on the determined result to the emission control driver 150, and thus the type of the onscreen display control unit 180 is not limited to the micom.

The onscreen display area 190 includes at least one pixel circuit at the organic light emitting display panel 120, and it is electrically connected to the emission control driver 150. The onscreen display area 190 is electrically connected to the emission control driver 150 via the separate emission control line (EM[N]). This is the difference with the other pixel circuits 121 of the organic light emitting display panel 120. That is, the onscreen display area 190 may emit light, separately.

The onscreen display area 190 may include an object pixel 191 (e.g., see FIG. 6*b*) on which the real information (e.g., a real image to be displayed) is displayed and an outline pixel 192 (e.g., see FIG. 6*b*), which serves as an outline of the object pixel 191, even though it is not separately illustrated in the drawings.

The object pixel 191 includes at least one pixel circuit in the onscreen display area 190. The object pixel 191 is the pixel in which the real data value is applied from the data driver 140 through the data line (D[M]), and the image information is displayed through the object pixel 191.

The outline pixel 192 includes at least one pixel circuit in the onscreen display area 190. The other pixels except for the object pixel 191 in the onscreen display area 190 correspond to the outline pixel 192. The outline pixel 192 is the pixel irrelative (i.e., have no relationship) to the real image information, and it emits light for contrast effect to obtain the outdoor visibility when the object pixel 191 emits light. That is, it is possible to improve the outdoor visibility of the onscreen display information, as the outline pixel emits the complementary color of the turned on pixels or produces shadow by displaying black images.

Hereinafter, the structures of the pixel circuit 121 and the onscreen display area 190 of the organic light emitting display 100 according to an embodiment of the present invention will be described.

Figure 3:
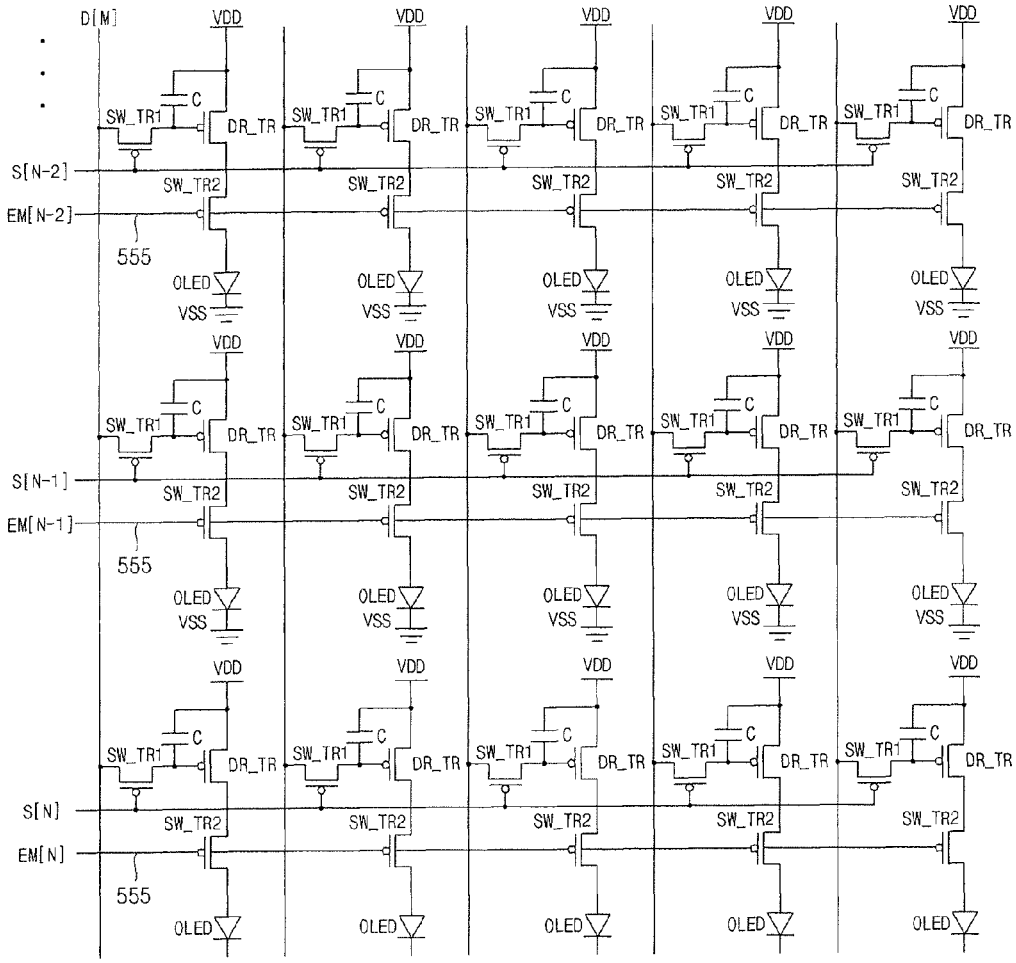
FIG. 3 is a circuit diagram schematically illustrating connecting relations of a pixel circuit and an emission control line in a conventional organic light emitting display.
Figure 4:
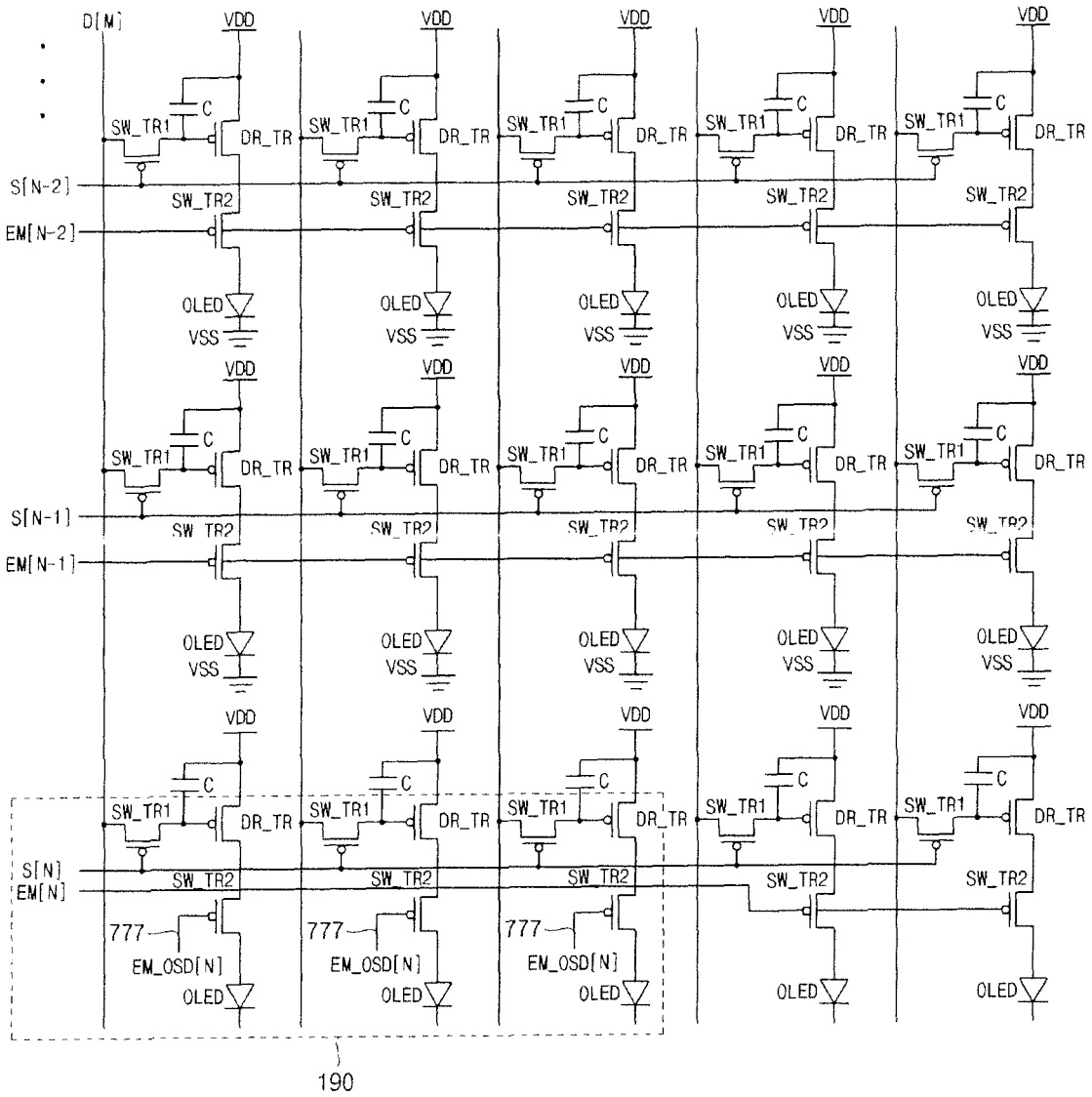
FIG. 4 is a circuit diagram schematically illustrating connecting relations of a pixel circuit and an emission control line formed on an onscreen display area in an organic light emitting display according to an embodiment of the present invention.

FIG. 3 is a circuit diagram schematically illustrating the connecting relations between the respective pixel circuit and the emission control line according to the conventional organic light emitting display, and FIG. 4 is a circuit diagram schematically illustrating the connecting relations of the circuit of the object pixel 191 and the circuit of the outline pixel 192 and the emission control line formed on the onscreen display area 190 in the organic light emitting display 100 according to an embodiment of the present invention.

As illustrated in FIG. 3, the emission line (EM[N]) 555 is commonly connected to second switching transistors (SW_TR2), which are arranged in the same line with reference to the row direction (see FIG. 3).

By contrast, as illustrated in FIG. 4, the emission line (EM[N]) is respectively connected to the second switching transistors (SW_TR2) in the circuits of the respective pixels 191, 192 formed on the onscreen display area 190.

That is, the organic light emitting display according to an embodiment of the present invention may be adapted to emission-control the respective pixel formed on the onscreen display area 190 by providing the emission control lines (EM_OSD[N]) 777 on the respective pixels 191, 192 formed on the onscreen display area 190.

Therefore, when the mobile display using the organic light emitting display 100 is determined to be positioned in the outdoor, then it is possible to select the position of the object pixel 191, which is turned on, and the outline pixel 192, which serves as an outline of the pixel, from the pixels in the onscreen display area 190, and it is possible to improve the outdoor visibility of the onscreen display information, as the outline pixel 192 emits the complementary color of the turned on pixel 191 or produces shadow by displaying black images.

Hereinafter, the approximate position of the onscreen display area 190 of the organic light emitting display 100 according to the present invention and the information to be displayed will be explained.

Figure 5:
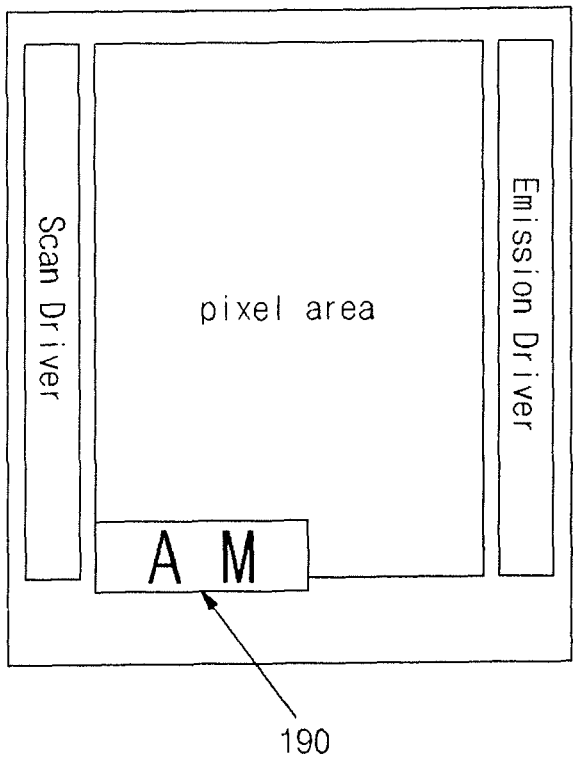
FIG. 5 is a schematic view schematically illustrating the onscreen display area in an organic light emitting display.

FIG. 5 is a schematic view illustrating the onscreen display area 190 in the organic light emitting display according to an embodiment of the present invention.

Referring to FIG. 5, the onscreen display area 190 may be formed on the left lower end of the organic light emitting display panel 120, and display information such as the morning time through an 'AM' image.

The onscreen display area 190 is formed on the left lower end of the organic light emitting display panel 120 in FIG. 5; however, it is only an embodiment for explaining the present invention. Also, the image such as 'AM' is also just an embodiment for explaining the present invention. Therefore, the onscreen display area 190 may be formed on various suitable regions of the organic light emitting display panel 120, and the display information of the onscreen display area 190 is not limited to the time information, and thus various suitable modifications can be made within the scope of the present invention.

Hereinafter, the emission manner of the onscreen display area 190 of the organic light emitting display 100 according to an embodiment of the present invention will be explained.

Figure 6A:
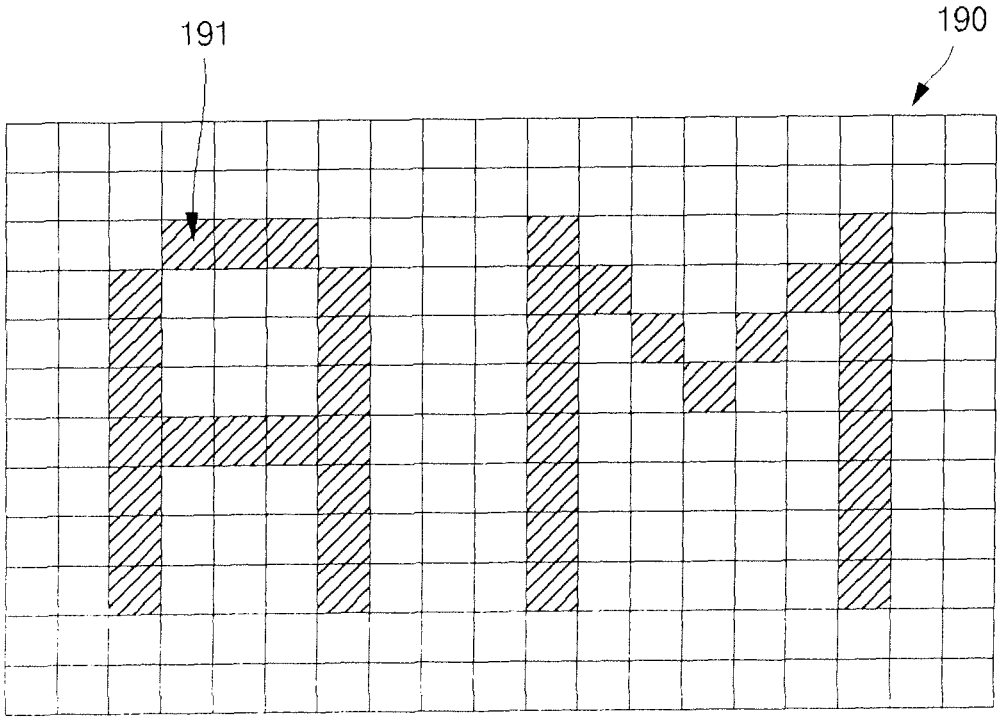
FIGS. 6*a* and 6*b* are schematic views for emphasizing the character outline of an onscreen display area in an organic light emitting display according to an embodiment of the present invention.
Figure 6B:
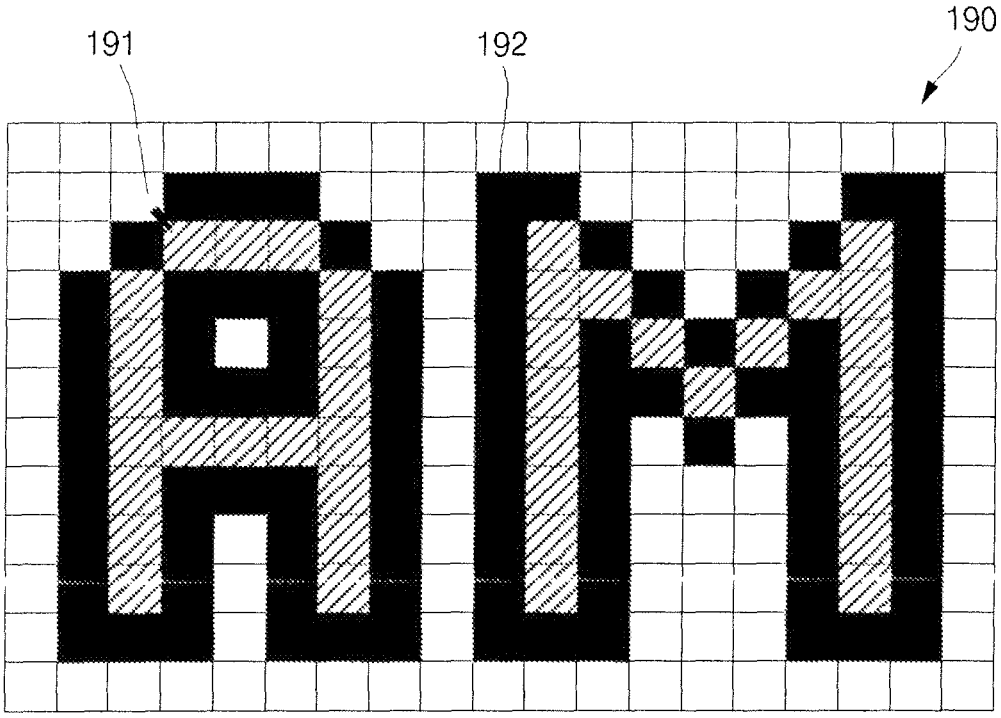

FIGS. 6*a* and 6*b* are schematic views emphasizing the outline of the character of the onscreen display area 190 in the organic light emitting display.

Referring to FIG. 6*a*, a character image 'AM' on the onscreen display information window as an onscreen display information character is illustrated therein. That is, the image information 'AM' is displayed on the object pixel 191. As illustrated in FIG. 6*a*, the visibility may be achieved with only low power consumption, when the onscreen display information character is displayed in the indoor.

However, there is a problem that the visibility is considerably reduced in the bright site, particularly in the outdoor. In particular, the mobile displays provided with an active matrix organic light emitting display (AMOLED) are frequently displayed in the outdoor, and therefore the mobile displays with the OLED have to solve the problem of low visibility in the outdoor.

For improving the visibility under external bright light, the display element should be turned on very brightly. However, it may reduce the lifespan of the organic light emitting element, and therefore the present invention provides the method capable of obtaining the visibility by controlling the outline pixels 192 formed around the object pixels 191 which display the image information.

Referring to FIG. 6*b*, the schematic view, capable of emphasizing the outline of the onscreen display character by controlling the outline pixels 192 formed around the object pixels 191 to be turned on, is illustrated therein.

As illustrated in FIG. 6*b*, it is possible to improve the outdoor visibility of the onscreen display information, as the outline pixels 192 emit the complementary color of the turned on pixels 191 or produce shadow by displaying black images. However, the present invention is not limited to applying an emission control method to the outline pixels 192, and thus various suitable alternations can be executed within the scope of the present invention.

Hereinafter, the pixel circuit of general organic light emitting display will be explained.

Figure 7:
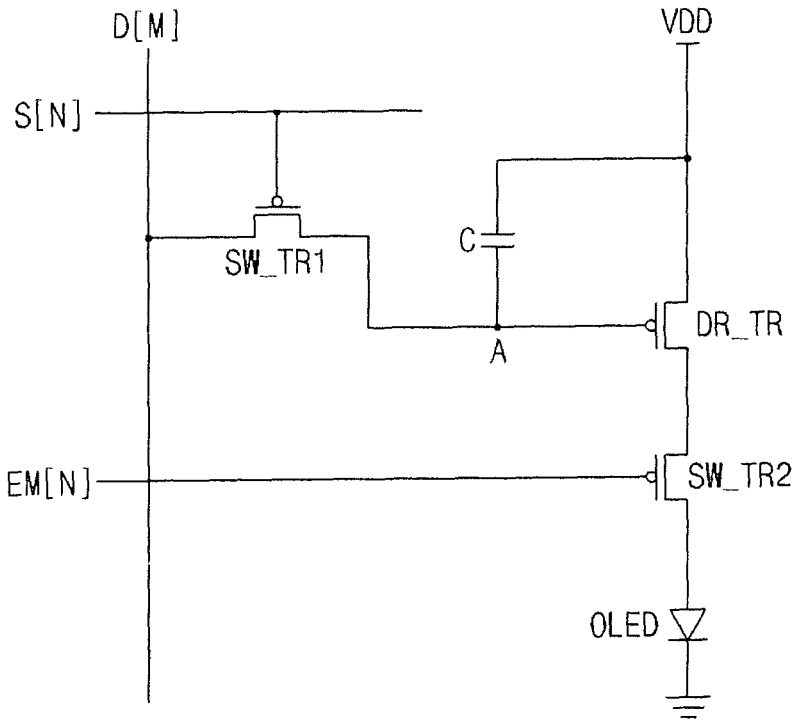
FIG. 7 is a circuit diagram schematically illustrating an exemplary embodiment of a pixel circuit in an organic light emitting display according to an embodiment of the present invention.
Figure 8:
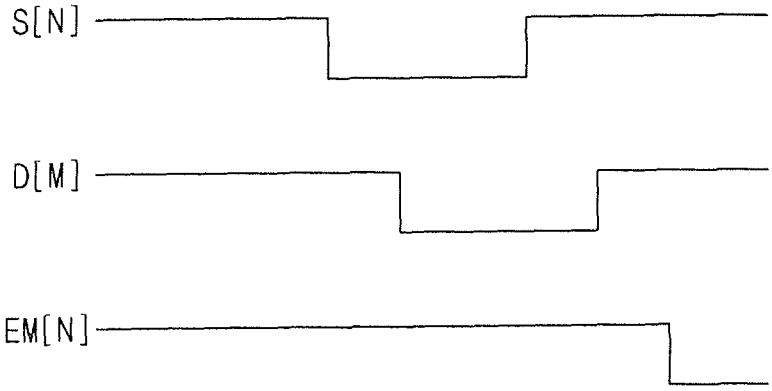
FIG. 8 is a timing diagram for driving the pixel circuit shown in FIG. 7.

FIGS. 7 and 8 respectively are a circuit diagram illustrating an exemplary embodiment of the pixel circuit 121 in the organic light emitting display and a driving timing view of the respective pixel circuit. Hereinafter, one of the circuits 121 of the organic light emitting display 100 in FIG. 2 that may be used to represent all the pixel circuits of the organic light emitting display 100 is described and shown for convenience of description purposes.

As illustrated in FIG. 7, the pixel circuit may include a scanning line (S[N]), a data line (D[M]), an emission control line (EM[N]), a power voltage line (VDD), a first switching transistor (SW_TR1), a second switching transistor (SW_TR2), a drive transistor (DR_TR), a storage capacitor (C) and an organic light emitting diode (OLED).

The action of the pixel circuit during one frame is described with reference to FIG. 8. As illustrated in FIG. 8, the scanning signal is supplied, after that the data signal is supplied with a time gap (or a slight time gap). The time gap is made in order to allow for a delay from the turn on time of the switching transistor by the supply of the scanning signal to the supply time of the data signal.

Once the scanning signal is supplied from the scanning line (S[N]), the first switching transistor (SW_TR1) is turned on. Therefore, the data signal (voltage) from the data line (D[M]) is supplied to a control electrode of the drive transistor (DR_TR) and a first electrode (A) of the storage capacitor (C).

Therefore, the organic light emitting diode (OLED) may emit light with specific brightness during one frame by providing the power voltage from the power voltage line (VDD) to the organic light emitting diode (OLED) through the drive transistor (DR_TR). The drive transistor (DR_TR) may maintain the turned on state when the scanning signal supply from the scanning line (S[N]) is blocked out, because the data voltage supplied from the data line (D[M]) is stored in the storage capacitor (C).

The control electrode of the second switching transistor (SW_TR2) is electrically connected to the emission control line (EM[N]). That is, the second switching transistor (SW_TR2) may control the current flowing into the OLED through the drive transistor (DR_TR) by being turned on, in case that the emission control signal of a low level is applied from the emission control line (EM[N]).

The emission control driver 150 may emission-control the respective pixel 191, 192 formed on the onscreen display area 190, respectively by providing the emission control line (EM_OSD[N]) separately in the respective pixel circuit formed on the onscreen display area (see FIG. 4).

That is, the object pixel 191 and the outline pixel 192 formed on the onscreen display area 190 may execute the emission control separately by the emission control driver 150 (see FIG. 2).

Hereinafter, the drive process of the organic light emitting display according to an embodiment of the present invention will be explained.

Figure 9:
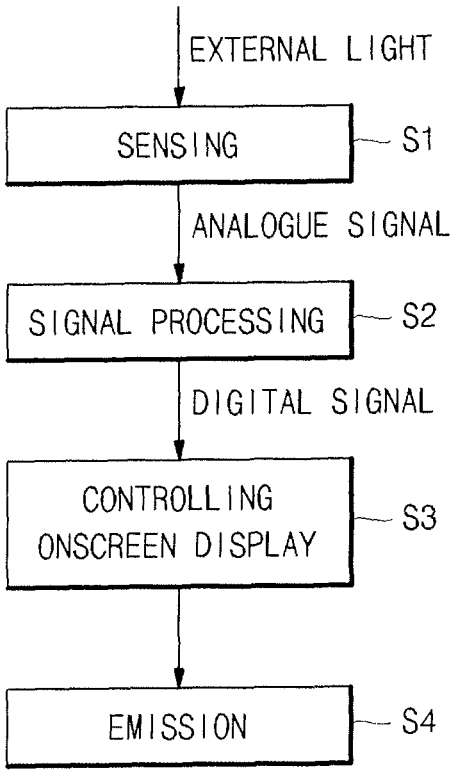
FIG. 9 is a flow chart illustrating a driving method of an organic light emitting display according to an embodiment of the present invention.

FIG. 9 is a flow chart illustrating a driving method of the organic light emitting display according to an embodiment of the present invention.

As illustrated in FIG. 9, the driving method of the organic light emitting display may include a sensing step (S1), a signal processing step (S2), an onscreen display control step (S3) and an emission step (S4).

The sensing step (S1) may sense the luminous intensity change of the external light when the mobile display is moved from the indoor to the outdoor. For this end, a photo-sensor capable of sensing the intensity of illumination of the external light may be used in the sensing step (S1).

The sensor step (S1) may sense the luminous intensity change of the external light, and supply the electrical analogue signal of the current or the voltage corresponding to the luminous intensity change of the external light into the signal processing unit 170 (see FIG. 2).

The sensor step (S1) may be executed by the sensor unit (or photo sensor) 160 (see FIG. 2) including a multitude of photo-diodes. A PN photo-diode, a PIN photo-diode and/or an avalanche photo-diode may be used as the photo-diode.

The present invention is not limited by the type of the photo sensor or the photo-diode to be used in the sensing step (S1), and thus any sensor capable of sensing the luminous intensity change between the visible ray from the sun light, the fluorescent lamp, and/or the incandescent light is sufficient.

The signal processing step (S2) may include a signal converting step and a signal determining step. The signal processing step (S2) may convert the analogue signal from the sensing step (S1) into the digital signal. For this end, the analog to digital converter (A/D converter) may be used in the signal converting step. However, any suitable device capable of converting the analogue signal into the digital signal is sufficient, and the present invention is not limited by the specific kind of the analog to digital converter.

The signal converting step may sample the analogue signal of the current or the voltage corresponding to the intensity of illumination of the external light, and output the digital signal of a specific bit from the sampled signal. That is, the signal converting step may convert the continuous analogue signal into the encoded digital signal, and provide the stable digital signal under a relatively noisy and irregular environment. The reason for conversion from the analogue signal to digital signal is that it is possible to transfer the signal more efficiently, because the digital signal is more definite and regular than the analogue signal and because it is easy to make an electronic circuit for dividing (e.g., separating or isolating) the signal from the irregular noise.

The signal determining step determines whether the organic light emitting display is to be in the indoor mode or the outdoor mode by using the signal outputted from the signal converting step. The output signal of the signal determining step may be applied to the onscreen display control unit 180 (see FIG. 2).

The onscreen display control step (S3) may determine whether the mobile display is moved into the bright site or the dark site by using the digital signal from the signal processing step (S2).

The onscreen display control step (S3) may use the micom (microcomputer) in order to determine that the mobile display has moved from the bright site to the dark site or from the dark site to the bright site. The micom is referred to as a computer composed of a micro processor and a central processing unit on a chip (or on one chip).

The micom may determine whether the mobile display has moved from the bright site to the dark site or from the dark site to the bright site by using the digital electrical signal from the signal processing step (S2). This micom can be any device, which is able to execute the calculation or process for determining whether the mobile display has moved from the bright site to the dark site or from the dark site to the bright site, and thus the present invention is not limited by the type of the micom.

Through the exchange of the signal with the micom, the onscreen display control step (S3) may supply an output signal according to the outdoor mode to the emission control driver or an output signal according to the indoor mode to the emission control driver. That is, it is possible to supply the control signal corresponding to the present position (indoor or outdoor) of the mobile display to the emission control driver 150 (see FIG. 2).

For example, when the mobile display is determined to be positioned in the outdoor, then the position of the outline pixels 192 of the object pixel 191 for displaying the image information from the pixels in the onscreen display area 190 are selected, and it is possible to supply the output signal producing shadow to the emission control driver 150 so that the outline pixels 192 emit the complementary color of the object pixel 191 or emit no light at all (i.e., produce black images).

That is, this calculation can be processed in the onscreen display control step (S3), and the output signal according to this calculation result may be supplied into the emission control driver 150.

The emission step (S4) may select the pixel for controlling the emission from the pixels in the onscreen display area 190 (see FIG. 2) in accordance with the output signal from the onscreen display control step (S3), and may control the emission of the pixels.

The emission step (S4) may select the positions of the object pixel 191 displaying the image information and the outline pixels 192 which serve as an outline of the object pixel 191 from the pixels in the onscreen display area 190. Further, it is possible to improve the outdoor visibility of the onscreen display information, as the pixels 192 emit the complementary color of the object pixels 191 or produce shadow by displaying black images.

The calculation may be executed in the onscreen display control step (S3), and the emission step (S4) may execute the emission control action according to the calculation result to the pixels 191, 192 formed on the onscreen display area 190 (see FIG. 2) corresponding to the calculation result.

As described above, the organic light emitting display and the driving method thereof may collect the information about the place where the organic light emitting display is displayed.

It is possible to emission-control each pixel formed on an onscreen display (OSD) area by providing an emission control line on each pixel formed on the area.

Also, it is possible to improve the outdoor visibility of onscreen display images by not only controlling the emission of the pixel, which is turned on within the onscreen display area, but also by controlling the emission of surrounding pixels, in accordance with the information about the place where the images are displayed.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic light emitting display including an organic light emitting display panel, the organic light emitting display comprising:

an emission control driver of the organic light emitting display panel;

a sensor unit for outputting an electrical output signal by sensing an external light;

a signal processing unit for determining an indoor mode or an outdoor mode in accordance with the output signal outputted from the sensor unit;

an onscreen display control unit electrically connected to the signal processing unit and for controlling the emission control driver of the organic light emitting display panel;

a first display area comprising a plurality of first pixels electrically connected to the emission control driver through a plurality of first emission control lines; and a second display area comprising a plurality of second pixels electrically connected to the emission control driver through at least one second emission control line, wherein at least two of the second pixels are immediately adjacent each other and are electrically connected to one of the at least one second emission control line and the first pixels coupled to a portion of a same scan line as the at least two of the second pixels are electrically connected to one of the first emission control lines, such that light emission of the at least one of the second pixels is controlled according to the external light independently of the first pixels coupled to the same scan line, and wherein the second display area is smaller than the first display area.

2. The organic light emitting display as claimed in claim 1, wherein the sensor unit is on the organic light emitting display panel, and wherein the organic light emitting display panel comprises the second pixels of the second display area and the first pixels of the first display area.

3. The organic light emitting display as claimed in claim 1, wherein the sensor unit comprises at least one photo-diode.

4. The organic light emitting display as claimed in claim 1, wherein the signal processing unit comprises:

a signal converting unit electrically connected to the sensor unit and for converting the output signal of the sensor unit into a digital signal; and a signal determining unit electrically connected to the signal converting unit and for determining the indoor mode or the outdoor mode.

5. The organic light emitting display as claimed in claim 4, wherein the signal converting unit is adapted to convert the output signal of the sensor unit into a square wave signal, and to eliminate a noise of the output signal of the sensor unit.

6. The organic light emitting display as claimed in claim 1, wherein the onscreen display control unit is adapted to select at least one of the second pixels of the second display area for controlling emission in accordance with a signal outputted from the signal processing unit.

7. The organic light emitting display as claimed in claim 1, wherein the onscreen display control unit is adapted to output an electrical signal for allowing the emission control driver to control an emission time of the second display area.

8. The organic light emitting display as claimed in claim 1, wherein the second pixels of the second display area comprise:

an object pixel on which real information is displayed; and an outline pixel serving as a boundary line of the object pixel.

9. The organic light emitting display as claimed in claim 8, wherein, when the object pixel is emitting light, the outline pixel is adapted to display the boundary line of the object pixel by emitting a complementary color of the object pixel or by emitting no light at all.

10. A driving method of an organic light emitting display, the method comprising:

sensing an external light by a sensor unit to output an electrical output signal in accordance with the sensing of the external light by the sensor unit;

processing the output signal of the sensor unit received by a signal processing unit to determine an indoor mode or an outdoor mode and to output a processed output signal;

onscreen display controlling an emission control driver of an organic light emitting display panel by an onscreen display control unit in accordance with the output signal of the signal processing unit received by the onscreen display control unit, the organic light emitting display panel comprising a first display area and a second display area, the first display area comprising a plurality of first pixels; and emitting light in the second display area comprising second pixels electrically connected to the emission control driver and controlled by the emission control driver, such that light emission of at least two of the second pixels, which are immediately adjacent each other, are controlled according to the external light during the outdoor mode independently of the first pixels coupled to a portion of a same scan line as the at least two of the second pixels, wherein the second display area is smaller than the first display area.

11. The driving method as claimed in claim 10, wherein the sensor unit is on the organic light emitting display panel.

12. The driving method as claimed in claim 10, wherein the sensor unit comprises at least one photo-diode.

13. The driving method as claimed in claim 10, wherein the processing the output signal comprises:

converting the output signal of the sensor unit into a digital signal by a signal converting unit electrically connected to the sensor unit; and determining the indoor mode or the outdoor mode with a signal determining unit electrically connected to the signal converting unit.

14. The driving method as claimed in claim 13, wherein the converting the output signal comprises:

converting the output signal of the sensor unit into a square wave signal by the signal converting unit; and eliminating a noise component of the output signal of the sensor unit.

15. The driving method as claimed in claim 10, wherein the onscreen display controlling comprises selecting at least one of the second pixels for controlling emission in accordance with the output signal received from the signal processing unit.

16. The driving method as claimed in claim 10, wherein the onscreen display controlling comprises outputting an electrical signal by the onscreen display control unit to allow the emission control driver to control an emission time of the display area.

17. The driving method as claimed in claim 10, wherein the second pixels of the second display area comprise:

an object pixel on which real information is displayed; and an outline pixel for outlining the object pixel.

18. The driving method as claimed in claim 17, further comprising:

displaying a boundary line of the object pixel by the outline pixel when the object pixel is emitting light.

19. The driving method as claimed in claim 18, wherein the displaying the boundary line comprises emitting a complementary color of the object pixel by the outline pixel.

20. The driving method as claimed in claim 18, wherein the displaying the boundary line comprises emitting no light at all by the outline pixel.

* * * * *